United States Patent [19]

Costa

[11] Patent Number: 4,857,876

[45] Date of Patent: Aug. 15, 1989

[54] SHUNT LATCH

[75] Inventor: Larry J. Costa, Danville, Ill.

[73] Assignee: Valmont Industries, Inc., Valley, Nebr.

[21] Appl. No.: 315,938

[22] Filed: Feb. 27, 1989

[51] Int. Cl.[4] ..... H01F 27/26

[52] U.S. Cl. ..... 336/165; 336/198; 336/210; 336/212

[58] Field of Search ..... 174/DIG. 2; 336/165, 336/160, 155, 210, 198, 208, 212; 361/377

[56] References Cited

U.S. PATENT DOCUMENTS 3,551,866 12/1970 Chass ..... 336/208

*Primary Examiner*—Thomas J. Kozma

*Attorney, Agent, or Firm*—Zarley, McKee, Thomte, Voorhees & Sease

[57] ABSTRACT

A shunt latch for a core-coil of a fluorescent light ballast comprising a substantially U-shaped metal shunt which is positioned in a shunt-receiving compartment defined by a pair of adjacent flanges. The adjacent flanges are provided with barb-like protrusions which permit the shunt to be inserted into the shunt-receiving compartment but which prevent the shunt from shifting from within the compartment or moving outwardly therefrom.

6 Claims, 2 Drawing Sheets

SHUNT LATCH

BACKGROUND OF THE INVENTION

A shunt is utilized in a ballast for fluorescent lights or the like to create a magnetic path between primary and secondary coil windings. Normally the shunt is comprised of a pair of flat metal members positioned on opposite sides of the ballast core between adjacent coil compartments such as described in the pending application Ser. No. 257,528, filed Oct. 14, 1988, entitled "An Improved Ballast." In some cases, the shunt is comprised of a flat, generally U-shaped metal member which partially embraces the core between adjacent coil compartments.

Inasmuch as the position of the shunt affects the performance of the ballast, it is important that the shunt be properly positioned initially and that the shunt remain in its proper position during the manufacture of the ballast as well as during the use thereof. Further, it is important that the shunt or shunts not be allowed to come into contact with any metal parts of the ballast, the result of which could cause vibration and undesirable ballast noise.

It is therefore a principal object of the invention to provide an improved shunt.

A further object of the invention is to provide an improved shunt latch which positively maintains the shunt in position during the manufacture of the ballast and during the subsequent use thereof.

Still another object of the invention is to provide a bobbin for use in a ballast including means for positively locking or latching the shunt in position so that the shunt cannot shift during the fabrication of the ballast or during subsequent use and which ensures that metal-to-metal contact will be avoided thereby reducing the possibility of vibration noise being created by the ballast.

Still another object of the invention is to provide a device of the type described which is easy to assemble.

These and other objects will be apparent to those skilled in the art.

SUMMARY OF THE INVENTION

Figure 1:
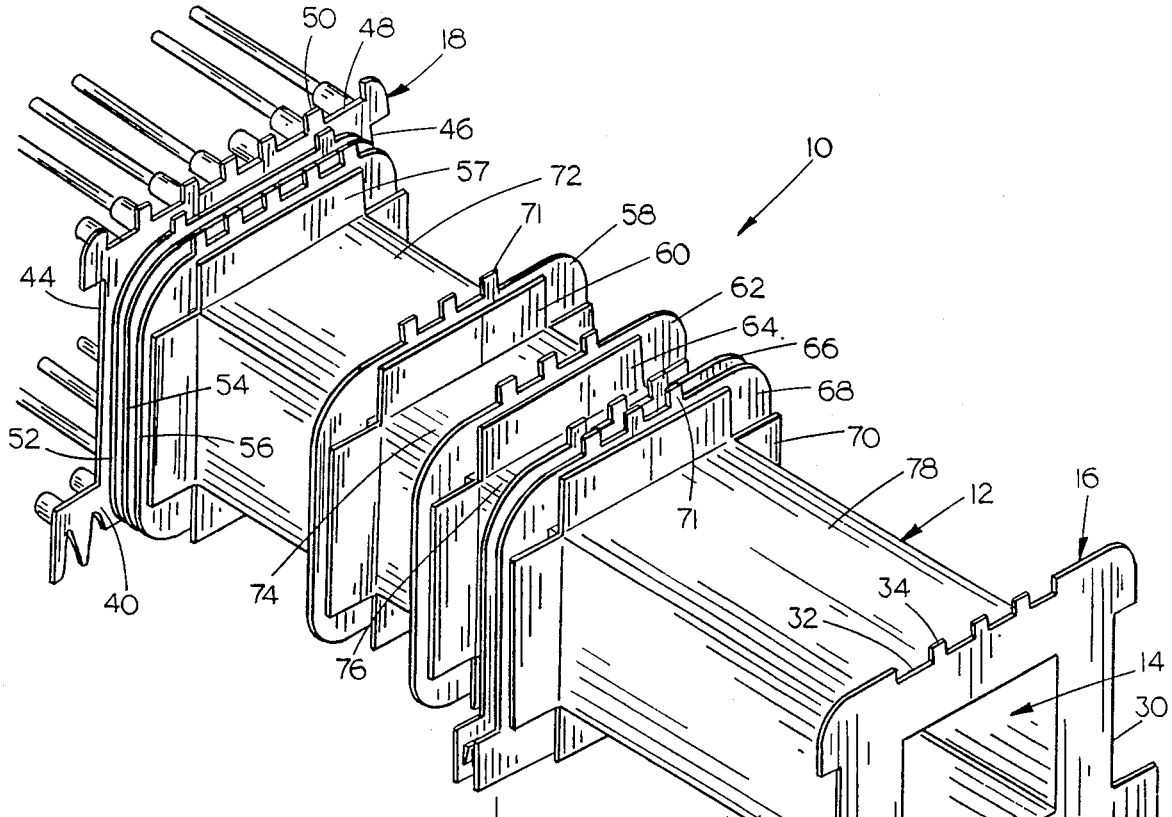
FIG. 1 is a perspective view illustrating the relationship of the shunt and the bobbin on which it is mounted.
Figure 2:
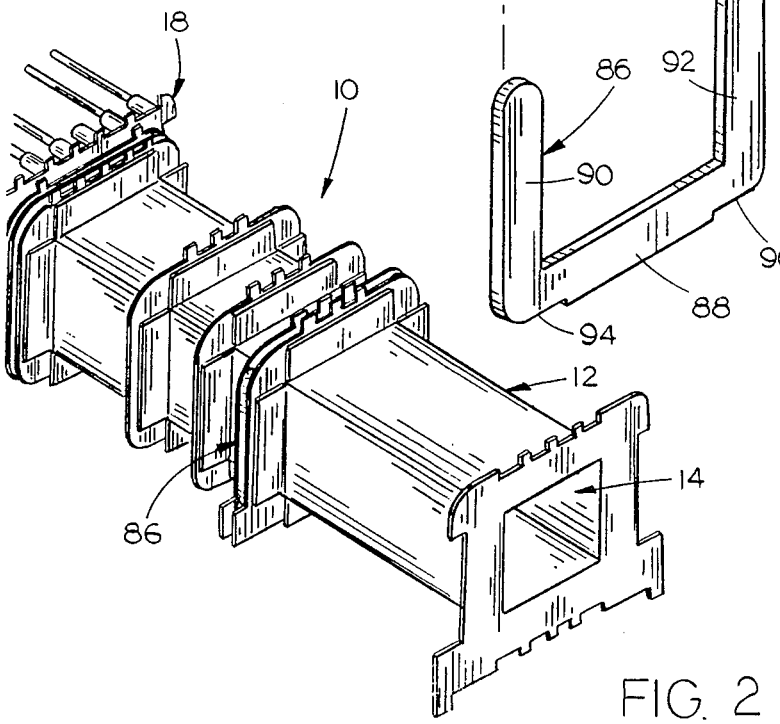
FIG. 2 is a perspective view illustrating the shunt latched into position on the bobbin.
Figure 5:
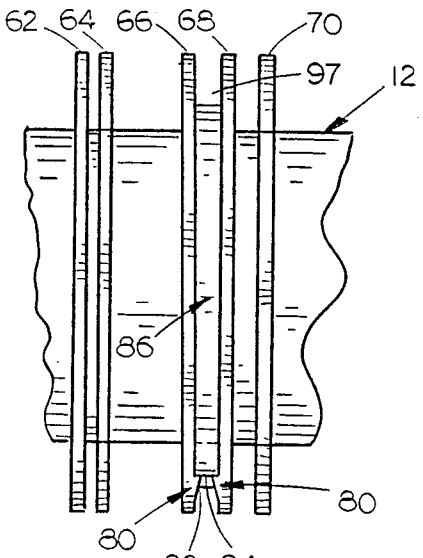
FIG. 5 is a view similar to FIGS. 3 and 4 except that the shunt has been locked into position by the shunt latching mechanism.

In this invention, a unitized bobbin is provided which has winding sections provided thereon adapted to have various coil windings wrapped thereon such as a secondary winding, one or more primary windings, and cathode coil windings. The bobbin is mounted on a metal core as described in the co-pending application, Ser. No. 257,528 entitled "An Improved Ballast." The bobbin of this invention is comprised of a thermoplastic material and is provided with a substantially square body section having an opening extending therethrough. The body section is provided with upstanding end portions at the opposite ends thereof. The bobbin is also provided with a plurality of radially extending flanges or walls which extend radially from the body section in a spaced-apart relationship to define cathode coil winding compartments, primary coil winding compartments, and secondary coil winding compartments. The bobbin is also provided with a pair of spaced-apart walls or flanges which extend radially from the body section to define a shunt compartment therebetween. The inside surfaces of the flanges which define the shunt compartment are provided with tapered barb-like members which are designed to maintain the shunt in position when the shunt has been inserted into the shunt compartment.

DESCRIPTION OF THE PREFERRED EMBODIMENT

The bobbin of this invention is referred to generally by the reference numeral 10 and is comprised of a thermoplastic material. Bobbin 10 is provided with a substantially square body portion or section 12 having an opening 14 extending therethrough. Body portion 12 is provided with upstanding ends 16 and 18 at the opposite ends thereof as seen in the drawings. End 16 is provided with standoffs 20 and 22 having downwardly extending foot portions 24 and 26 respectively. End 16 is provided with notches 28 and 30 extending into the sides thereof. The upper end of end 16 has a plurality of spaced-apart notches 32 formed therein separated by tabs 34. As seen in the drawings, the lower end of end 16 is also provided with a plurality of spaced-apart notches 36 separated by tabs 38 which serve as conductor tab-anchoring mechanisms.

End 18 is provided with standoffs 40 and 42 (not shown) having downwardly extending foot portions similar to end 16. A pair of notches 44 and 46 extend into the sides of end 18 as seen in FIG. 1. The upper end of end 18 has a plurality of notches 48 formed therein separated by tabs 50. The lower end of end 18 is also provided with a plurality of notches separated by a plurality of tabs similar to that on end 16. The bobbin 10 would normally include terminals or terminal supports at end 18 and possibly at end 16 as needed.

Flanges or walls 52, 54 and 56 extend radially from body portion 12 in a spaced-apart relationship to define cathode coil winding sections or compartments therebetween. Flange 57 is spaced from flange 56 to create a space therebetween. Similarly, flanges 58, 60, 62, 64, 66, 68, and 70 extend radially outwardly from body 12 as seen in the drawings. The various flanges also have anchoring tabs 71 provided on their upper and lower edges or ends respectively.

Flanges 57 and 58 create or define a primary coil winding section or compartment 72 while flanges 60 and 62 define a primary coil winding section or compartment 74. Flanges 64 and 66 define a coil winding section or compartment 76 which may or may not be used depending upon the particular ballast being manufactured. Flange 70 and end 16 define a secondary coil winding section or compartment 78. Flanges 58–60, 62–64 and 68–70 define spaces therebetween which are adapted to have termination or ends of the coil windings extending therethrough. Layers of wire would be wrapped around the bobbin 70 in the various sections or compartments described hereinabove to create the desired coil windings.

Figure 4:
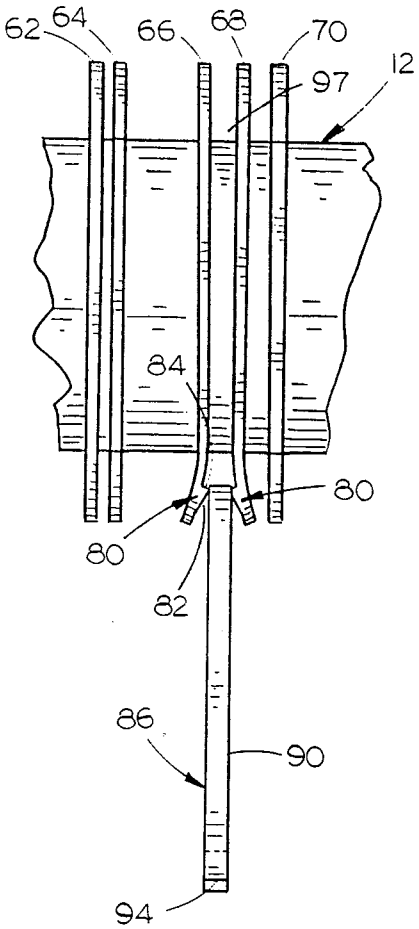
FIG. 4 is a view similar to FIG. 3 but which illustrates the shunt deflecting the latching mechanism.
Figure 3:
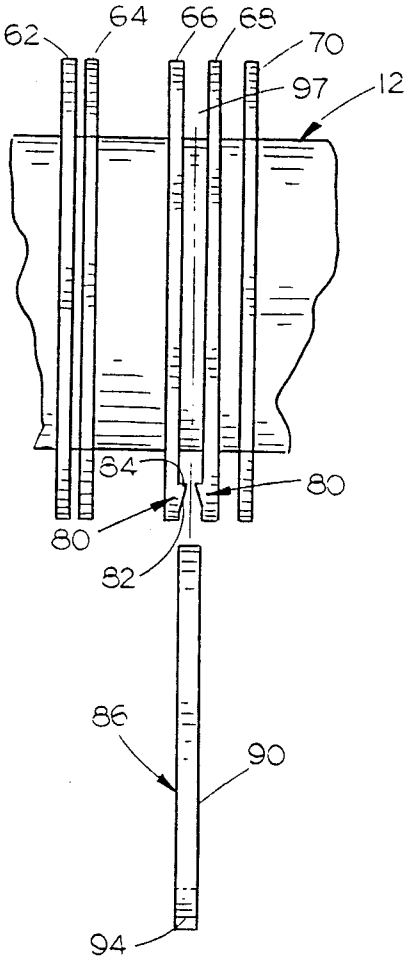
FIG. 3 is a side view illustrating the shunt about to be inserted into the shunt compartment.

The inside surfaces of flanges 66 and 68 are each provided with a pair of barb-like protrusions 80 having tapered surfaces 82 and shoulders 84. The numeral 86 refers generally to a flat, substantially U-shaped metal shunt including a base portion 88 and depending legs 90 and 92. Base 88 is provided with a pair of recessed portions 94 and 96 at one edge thereof as seen in FIG. 1. Shunt 86 is adapted to be positioned between the flanges 66 and 68, which define a shunt compartment 97, so that the legs 90 and 92 are positioned on opposite sides of the body portion 12 as also seen in the drawings. The shunt 86 is slipped upwardly between the flanges 66 and 68 with the inclined surfaces 82 of the projections 80 permitting the shunt to pass thereby as seen in FIG. 4. As soon as the recessed portions 94 and 96 have passed by shoulder 84 of the projections 80, the shoulders 84 position themselves over the recessed portions 94 and 96 to prevent any movement of the shunt 86.

Thus, the barb-like projections 80 act as a shunt latch to positively maintain the shunt in the proper position during the manufacture or fabrication of the ballast so that the operating characteristics of the ballast will not change. Further, the shunt latch described hereinabove ensures that the shunt will not move during subsequent use of the ballast. Additionally, the shunt latch described hereinabove ensures that the metal shunt cannot come into contact with any other metal parts of the ballast thereby eliminating undesirable vibration and attendant noise.

Thus it can be seen that the invention accomplishes at least all of its stated objectives.

I claim:

1. A core-coil means for a fluorescent light ballast comprising, an elongated rectangular bobbin having opposite ends, a top wall, a bottom wall, opposite side walls, and a central opening extending therethrough, said bobbin having a plurality of spaced-apart flanges extending radially therefrom, at least some of said flanges defining coil compartments, a primary winding wrapped around said bobbin in one of said compartments, at least one secondary winding wrapped around said bobbin in another of said compartments, a core means associated with said bobbin and comprising opposite end portions, opposite side portions, and a central portion extending between said side portions, said center portion of said core means being positioned in, and extending through, said central opening of said bobbin, said side portions of said core means being positioned outwardly of the side walls of said bobbin, said end portions of said core means being positioned outwardly of the ends of said bobbin, two of said flanges being closely spaced apart to define a shunt receiving compartment therebetween, a substantially U-shaped metal shunt positioned in said shunt receiving compartment and including a flat base portion having flat legs depending therefrom, and means on at least one of said flanges for maintaining said shunt in said shunt receiving compartment.

2. The core-coil means of claim wherein said means comprises at least one beveled shoulder means.

3. The core-coil means of claim 1 wherein said means comprises at least a pair of spaced-apart barb-like protrusions.

4. The core-coil means of claim 3 wherein said flat base portion has a pair of spaced-apart recessed portions formed therein, said protrusions being received by said recessed portions.

5. The core-coil means of claim 1 wherein said means comprises two pairs of spaced-apart barb-like protrusions.

6. A core-coil means for a fluorescent light ballast comprising, an elongated rectangular bobbin having opposite ends, a top wall, a bottom wall, opposite side walls, and a central opening extending therethrough, said bobbin having a plurality of spaced-apart flanges extending radially therefrom, at least some of said flanges defining coil compartments, two of said flanges being closely spaced apart to define a shunt receiving compartment therebetween, a substantially U-shaped metal shunt positioned in said shunt receiving compartment and including a flat base portion having flat legs depending therefrom, and means on at least one of said flanges for maintaining said shunt in said shunt receiving compartment.

* * * * *